US005326951A

United States Patent [19]

Murakami

[11] Patent Number: 5,326,951

[45] Date of Patent: Jul. 5, 1994

[54] PUSH BUTTON SWITCH

[75] Inventor: Takahiro Murakami, Iwaki, Japan

[73] Assignee: Alps Electric Co., Ltd., Tokyo, Japan

[21] Appl. No.: 3,173

[22] Filed: Jan. 12, 1993

[30] Foreign Application Priority Data

Jan. 23, 1992 [JP] Japan ..... 4-001966
Jan. 23, 1992 [JP] Japan ..... 4-010038
Jan. 23, 1992 [JP] Japan ..... 4-010083
Jan. 23, 1992 [JP] Japan ..... 4-010084

[51] Int. Cl.[5] ..... H01H 13/14

[52] U.S. Cl. ..... 200/520; 200/408; 200/514; 200/239; 200/530

[58] Field of Search ..... 200/520, 521, 530, 238, 200/239, 243, 345, 341, 344, 511, 262, 408, 409, 514, 264, 239

[56] References Cited

U.S. PATENT DOCUMENTS 3,922,513 11/1975 Kravchuck ..... 200/238
4,050,756 9/1977 Moore ..... 200/511
4,528,431 7/1985 Coleman ..... 200/408
4,859,820 8/1989 Gotfryd et al. ..... 200/521
5,010,219 4/1991 Kato ..... 200/521
5,075,524 12/1991 Klatt et al. ..... 200/521

FOREIGN PATENT DOCUMENTS 63222 2/1913 Fed. Rep. of Germany ..... 200/520
2288031 11/1990 Japan ..... 200/520

*Primary Examiner*—Henry J. Recla
*Assistant Examiner*—David J. Walczak
*Attorney, Agent, or Firm*—Guy W. Shoup; David W. Heid; Patrick T. Bever

[57] ABSTRACT

A push button switch comprises a housing having an opening at the top and provided with a fixed contact member at the inner bottom, a stem supported to be vertically movable in and with respect to the housing, and an elastic member being capable of buckling and having one end attached to near a lower end of the stem and the other end attached to near the inner bottom of the housing, the elastic member being positioned in the housing to extend diagonally and urging the stem upward by its own resilient force. A high degree of reliability is ensured with the simple structure and a good click feeling is provided.

6 Claims, 4 Drawing Sheets

PUSH BUTTON SWITCH

FIELD OF THE INVENTION

The present invention relates to a push button switch with a click feeling which is switched on by utilizing buckling of an elastic member, such as a coil spring, slantly built in a housing.

DESCRIPTION OF THE RELATED ART

As disclosed in U.S. Pat. No. 4,528,431, one of the above type push button switches is conventionally known as having a coil spring built in a housing and buckled to rotate an actuator, whereby the actuator turns on a switch element such as a membrane switch. More specifically, both ends of the coil spring are respectively fixed to a stem and an actuator. When an operator depresses the stem through a predetermined stroke to make the coil spring compressed in a predetermined extent, the built-in coil spring is buckled and the actuator is rotated following the buckling of the coil spring. As a result, a movable contact of the switch element is pushed by the actuator to come into contact with a fixed contact. Since a click feeling is produced upon the coil spring being buckled, the operator can perceive at his or her finger shifting into a switch-on state.

When the operating force to depress the stem is released in the switch-on state, the stem is raised up along the housing to its initial position by a restoring force of the buckled coil spring. Simultaneously, the actuator is rotated in a direction reversed to that in the above buckling action and the switch element is returned to a switch-off state.

Thus, a push button switch of the type buckling a coil spring to turn on the switch is advantageous in that a good click feeling can be always obtained.

However, the above-mentioned conventional push button switch has a drawback that the structure is complicated and the cost is essentially increased, because the buckling of the coil spring must be converted into the rotation of the actuator and the movable contact of the switch element must be positively brought into contact with the fixed contact through the rotation of the actuator.

SUMMARY OF THE INVENTION

The present invention has been made in view of the problem in the prior art, and its object is to provide a push button switch which can ensure high reliability with the simple structure and give a good click feeling.

To achieve the above object, a push button switch of the present invention is featured in, as first means, comprising a housing having an opening at the top and provided with a fixed contact member at the inner bottom, a stem supported to be vertically movable in and with respect to said housing, and an elastic member being capable of buckling and having one end attached to near a lower end of said stem and the other end attached to near the inner bottom of said housing, said elastic member being positioned in said housing to extend diagonally and urging said stem upward by its own resilient force.

The present invention is also featured in, as second means, a push buttom switch according to the first means, wherein said elastic member is a coil spring, said coil spring having one end supported by first support means near the lower end of said stem and the other end supported by second support means near the inner bottom of said housing, at a position in diagonally opposite relation to said first support means, with a resilient force of said coil spring, whereby a part of one end of said coil spring is separated away from said first or second support means when said coil spring is buckled.

The present invention is further featured in, as third means, a push button switch according to the first means, wherein a buckling compeller projection is provided at the lower end of said stem for pressing said elastic member downward and inducing said elastic member to buckle when said stem is moved downward.

The present invention is featured in, as fourth means, a push button switch according to the first means, wherein said fixed contact member is formed by integrally molding a pair of conductive rubber portions with an insulating rubber portion held between said conductive rubber portions.

The present invention is featured in, as fifth means, a push button switch according to the fourth means, further comprising connection terminals which have parts held in pressure contact with respective upper surfaces of said conductive rubber portions and which are locked to said housing by twisting those portions extending to the outside of said housing, whereby said fixed contact member is secured to the inner bottom of said housing by being sandwiched between said connection terminal and the inner bottom surface of said housing.

The present invention is featured in, as sixth means, a push button switch according to the first means, wherein said switch is used in such a manner that a plurality of said housings are arrayed on a data input unit for use in an information processing apparatus.

A push button switch of the present invention is featured in, as seventh means, comprising a housing having an opening at the top and provided with a fixed contact member at the inner bottom, a stem supported to be vertically movable in and with respect to said housing, and a conductive elastic member being capable of buckling and having one end attached to near a lower end of said stem and the other end attached to near the inner bottom of said housing, said elastic member being positioned in said housing to extend diagonally and urging said stem upward by its own resilient force, wherein a buckling portion of said elastic member is brought into contact with said fixed contact member.

Finally, a push button switch of the present invention is featured in, as eighth means, comprising a housing having an opening at the top and provided with a fixed contact member at the inner bottom, a stem supported to be vertically movable in and with respect to said housing, an elastic member being capable of buckling and having one end attached to near a lower end of said stem and the other end attached to near the inner bottom of said housing, said elastic member being positioned in said housing to extend diagonally and urging said stem upward by its own resilient force, and a movable contact member having flexibility and disposed between said fixed contact member and said elastic member in opposite relation to said fixed contact member, wherein said movable contact member and said fixed contact member are brought into contact with each other upon buckling of said elastic member.

With the first means, because of no need of an actuator, the structure can be simpler than conventional switches which similarly utilize buckling of a coil spring.

With the second means, the movable support structure in which the housing supports one end of the coil spring in an unfixed state is adopted so that the same end will not be restricted by the housing when the coil spring is buckled, thus making it possible to buckle the coil spring to a large extent and, therefore, provide a very good click feeling.

With the third means, the buckling compeller projection compels the coil spring to start buckling upon the stem being depressed through a predetermined stroke, whereby the coil spring can be positively buckled even if its spring constant varies to some extent, and variations in the timing of turning-on are also small.

With the fourth means, the conductive rubber portions of the rubber molding are used as the fixed contacts, whereby an impact produced upon buckling of the coil spring is mitigated by the rubber molding and a fear that a spark may occur when metal members are brought into contact with each other can be avoided. Further, since the rubber molding can be formed such that the distance between a pair of the conductive rubber portions is determined with high accuracy through the insulating rubber portion and a pair of the conductive rubber portions are surely insulated from each other even when they are closely disposed, an improvement in the space factor is resulted.

With the fifth means, the resilient force of the rubber molding ensures positive conduction between the conductive rubber portions and the metal terminals, and the rubber molding is tightly sandwiched between the metal terminals and the housing. Therefore, the rubber molding (i.e., the fixed contacts) and the metal terminals can be simply and positively attached to the housing with no need of insert molding which essentially leads to the increased cost.

With the sixth means, a keyboard with high reliability can be provided at the reduced cost.

With the seventh means, the buckling portion of the coil spring as an elastic buckling member is formed to be highly conductive and the coil spring itself is utilized as a movable contact by making the buckling portion come into or out of contact with a pair of the conductive rubber portions, at least the movable contact and the actuator can be dispensed with to further simplify the structure as compared with conventional switches having a coil spring built in to double as a return spring and a click spring.

Finally, with the eighth means, a contact sheet as the movable contact member is disposed in covering relation to the rubber molding and, therefore, dusts can be prevented from intruding into the contact space.

DETAILED DESCRIPTION OF THE PREFERRED EMBODIMENT

Figure 1:
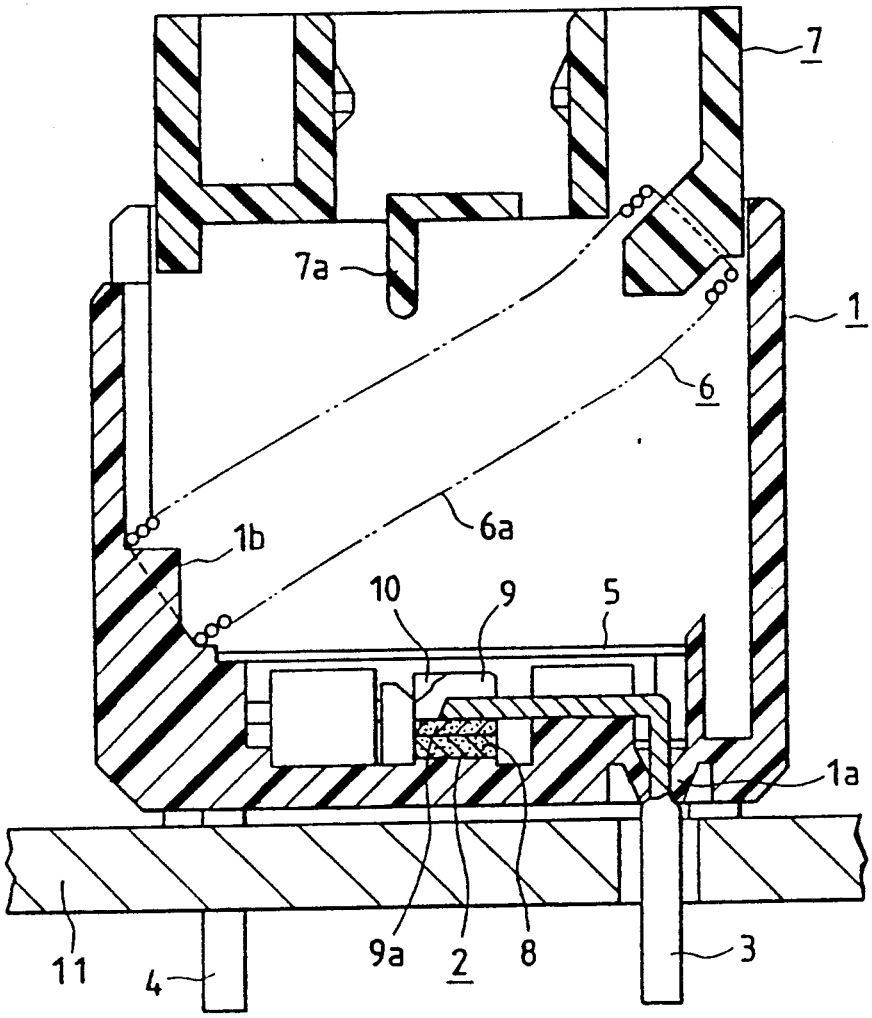
FIG. 1 is a sectional view of a push button switch in its inoperative state according to one embodiment.
Figure 2:
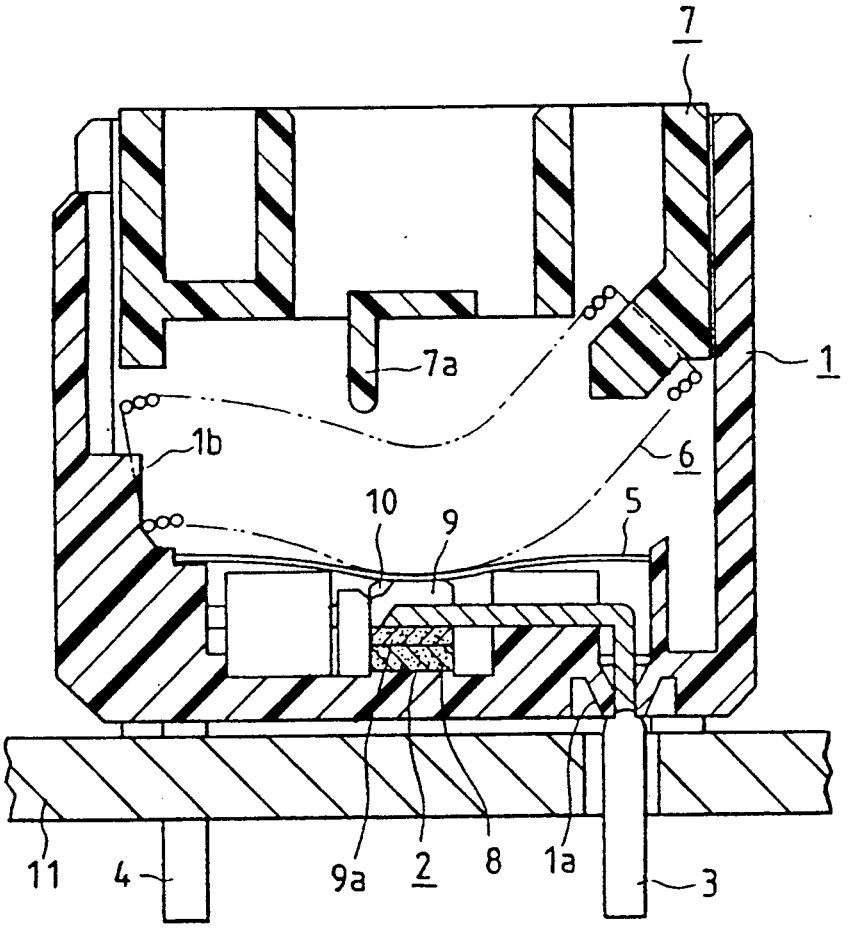
FIG. 2 is a sectional view of the push button switch in its operative state under depression.

Hereinafter, one embodiment of a push button switch according to the present invention will be described with reference to FIGS. 1 to 4. In these drawings, FIG. 1 is a sectional view of the push button switch in its inoperative state, FIG. 2 is a sectional view of the push button switch in its operative state under depression, FIG. 3 is a sectional view of principal parts showing the attachment structure of a rubber molding built in the push button switch, and FIG. 4 is a perspective view of principal parts showing the attachment structure of a metal terminal built in the push button switch.

The push button switch shown in the drawings comprises a housing 1 which is made of synthetic resin material, a rubber molding 2 which is fixedly placed on an inner bottom surface of the housing 1, a pair of metal terminals 3, 4 each of which comprises rectangular sheet material bent into substantially the form of a channel and has both ends projected downwardly from the housing 1, a contact sheet 5 which comprises a flexible member fabricated by printing a conductive pattern on a resin film and is arranged at a position facing an upper surface of the rubber molding 2, a coil spring 6 which is slantly arranged in the housing to position above the contact sheet 5 and undergoes an elastic deformation inclusive of buckling, and a stem 7 which is vertically movable in and with respect to the housing 1 and normally urged upward by the coil spring 6. When the stem 7 is depressed downward against a resilient force of the coil spring 6 through a predetermined stroke, the coil spring 6 is buckled downward upon its compression in a predetermined extent so that a buckling portion 6*a* of the coil spring 6 pushes a central portion of the contact sheet 5 downward.

Figure 3:
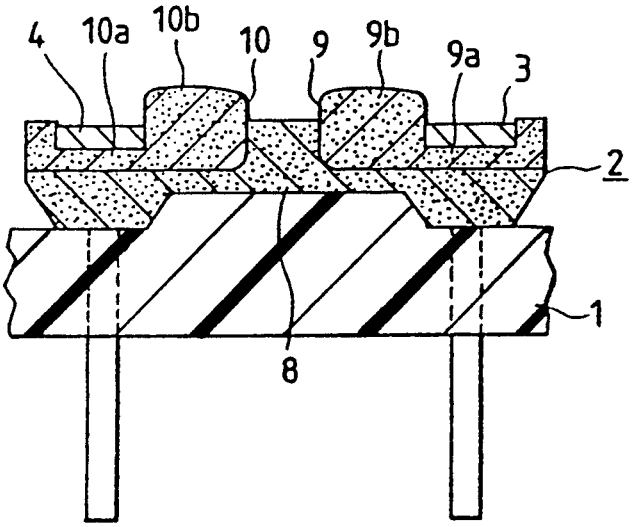
FIG. 3 is a sectional view of principal parts showing the attachment structure of a rubber molding built in the push button switch.
Figure 4:
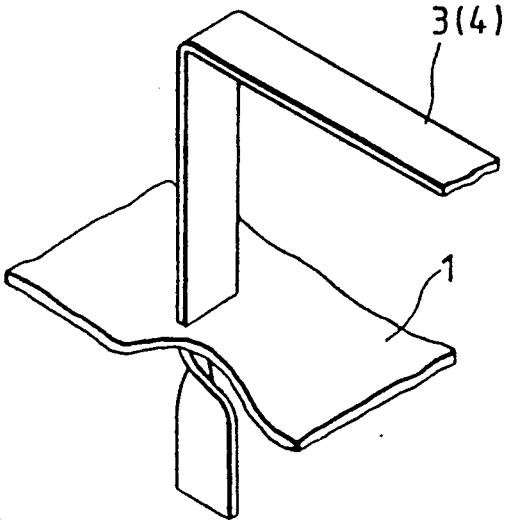
FIG. 4 is a perspective view of principal parts showing the attachment structure of a metal terminal built in the push button switch.
Figure 5:
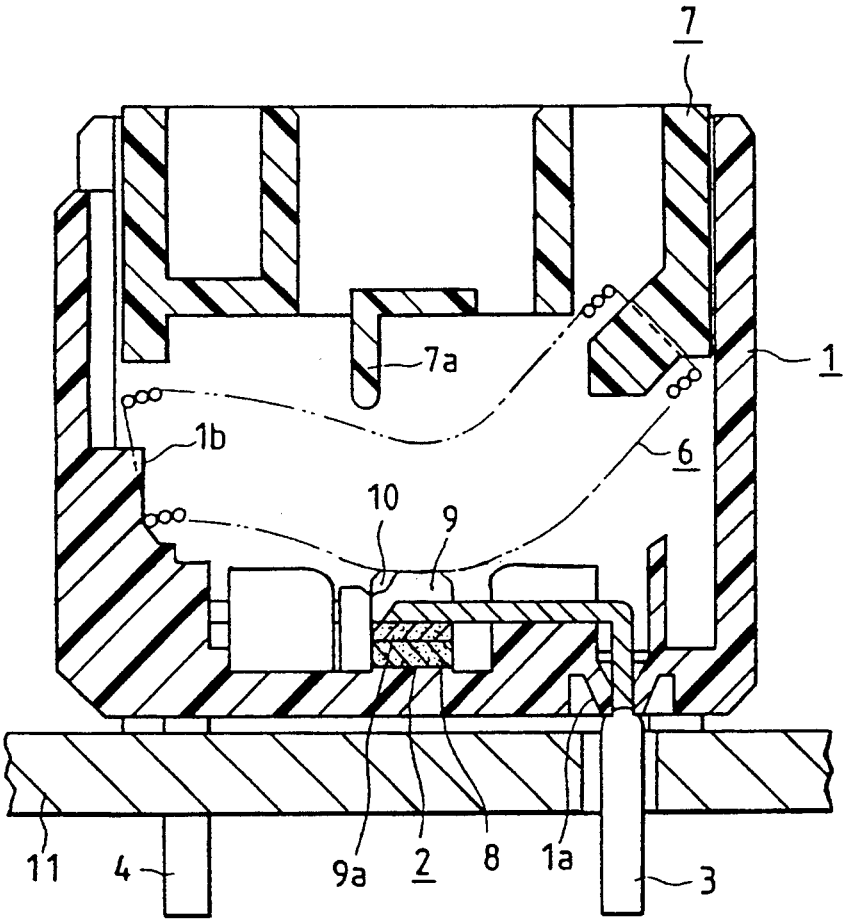
FIG. 5 is a sectional view of a push button in its operative state under depression showing the buckling portion contacting the fixed contacts

As will be seen from FIG. 3, the rubber molding 2 is an integrally molded product which comprises an insulating rubber portion 8 formed of silicone rubber and a pair of conductive rubber portions 9, 10 which are formed of conductive rubber material prepared by mixing and kneading conductive powder with silicone rubber and are disposed on the insulating rubber portion 8 side by side with a central area of the insulating rubber portion 8 therebetween. The metal terminals 3, 4 are held in pressure contact with respective thinner wall regions 9*a*, 10*a* of the conductive rubber portions 9, 10. In other words, the metal terminals 3, 4 each having a substantially channel-like shape are locked to the housing 1 by twisting about 90° those portions of the metal terminals projecting downward from the housing 1, as shown in FIG. 4, under a condition that their central portions are pressed against the thinner wall regions 9*a*, 10*a* of the conductive rubber portions 9, 10. The metal terminals 3, 4 attached to the housing 1 are maintained in a pressure contact state with the conductive rubber portions 9, 10 by a resilient force of the rubber molding 2, and both end portions of the rubber molding 2 itself are tightly held between the metal terminals 3, 4 and the housing 1. Additionally, terminal penetrating portions 1*a* of the housing 1 through which the metal terminals 3, 4 are projected to the outside are formed into a substantially V-shape for preventing spill-out of flux.

While one end of the coil spring 6 as an elastic buckling member is fixed to the stem 7, the other end is resiliently contacted with the peripheral edge of a positioning projection 1*b* in the housing 1 but not fixed thereto. Thus, the housing 1 supports the other end of the coil spring 6 in an unfixed state. Accordingly, when buckled, the other end of the coil spring 6 is allowed to turn about the positioning projection 1*b* in a direction to move away from the housing 1, as shown in FIG. 2, thereby ensuring a large buckling action of the coil spring 6. The buckling portion 6*a* of the coil spring 6 which has buckled downward makes the central portion of the contact sheet 5 bent toward the rubber molding 2, as shown in FIG. 2. Therefore, the conductive pattern of the contact sheet 5 is brought into abutment against thicker wall regions 9*b*, 10*b* of the conductive rubber portions 9, 10, whereby the conductive rubber portions 9, 10 normally kept in an insulated state are conducted to each other via the contact sheet 5. Stated otherwise, in this push button switch, the thicker wall regions 9*b*, 10*b* of the conductive rubber portions 9, 10 serve as fixed contacts and the contact sheet 5 is used as a movable contact capable of contacting with or separating from these fixed contacts. Alternatively, it is also possible to use the coil spring as a movable contact without providing the contact sheet.

Furthermore, at the center of a bottom surface of the stem 7, there is provided a buckling compeller projection 7*a* coming into abutment against the buckling portion 6*a* of the coil spring 6 when the stem 7 is depressed to move downward. The coil spring 6 is compelled to start buckling by being pushed downward with the projection 7*a*.

Incidentally, reference numeral 11 in the drawings denotes a printed board on which the push button switch is mounted. The metal terminals 3, 4 are soldered to a circuit pattern on the printed board 11.

Operation of the above-explained push button switch will be briefly described below.

In the inoperative state shown in FIG. 1, since a pair of the conductive rubber portions 9, 10 within the housing 1 are insulated from each other, the push button switch is held in an off-state. When the operator depresses the stem 7 downward under such a condition, the coil spring 6 is buckled to produce a click feeling at the time the stem 7 is depressed through a predetermined stroke. Immediately thereafter, as shown in FIG. 2, the contact sheet 5 is pushed downward by the buckling portion 6*a* of the coil spring 6 to bend into abutment against a pair of the conductive rubber portions 9, 10, whereupon the conductive rubber portions 9, 10 are conducted to each other via the contact sheet 5 to establish a switch-on state. At this time, the operator can perceive shifting into the switch-on state from a click feeling transmitted to his or her finger.

When the operating force to depress the stem 7 is removed in the switch-on state, the buckled coil spring 6 is returned to the state of FIG. 1 by an its own restoring force. Accordingly, the contact sheet 5 ceases from bending and separates away from the conductive rubber portions 9, 10 for shifting of the switch into the off-state. The restoring force of the coil spring 6 also raises the stem 1 along the housing 1 up to its initial position.

With this embodiment, as explained above, since the contact sheet 5 is bent by the buckling portion 6*a* of the coil spring 6 so that the contact sheet 5 can be positively brought into contact with the conductive rubber portions 9, 10, there can be obtained a highly reliable push button switch in which the contact sheet 5 serves as a movable contact. Another advantage is in that because of no need of an actuator, the structure can be simpler than conventional switches which similarly utilize buckling of a coil spring. Additionally, since the contact sheet 5 is disposed in covering relation to the rubber molding 2, dusts can be prevented from intruding into the contact space, which also contributes to higher reliability.

As an alternative, when the buckling portion 6*a* of the coil spring 6 as an elastic buckling member is formed to be highly conductive and the coil spring 6 itself is utilized as a movable contact by making the buckling portion 6*a* come into or out of contact with a pair of the conductive rubber portions 9, 10, at least the movable contact and the actuator can be dispensed with to further simplify the structure as compared with conventional switches having a coil spring built in to double as a return spring and a click spring.

Moreover, since the above-explained embodiment adopts the movable support structure in which the housing 1 supports one end of the coil spring 6 in an unfixed state so that the same end will not be restricted by the housing when the coil spring is buckled, it is possible to buckle the coil spring 6 to a large extent and, therefore, provide a very good click feeling.

Additionally, with the above-explained embodiment, since the buckling compeller projection 7*a* compels the coil spring 6 to start buckling upon the stem 7 being depressed through the predetermined stroke, the coil spring 6 can be positively buckled even if its spring constant varies to some extent, and variations in the timing of turning-on are also small.

With the above-explained embodiment, the metal terminals 3, 4 are locked to the housing 1 by simple twisting under a condition that the metal terminals 3, 4 are pressed against the conductive rubber portions 9, 10 of the rubber molding 2 disposed on the inner bottom surface of the housing 1, so that the rubber molding 2 can be automatically fixed at a predetermined position inside the housing 1 by fixing the metal terminals 3, 4 in the housing 1. Therefore, the fixed contacts (i.e., the conductive rubber portions 9, 10) and the metal terminals 3, 4 can be simply and positively attached to the housing 1 with no need of insert molding which essentially leads to the increased cost. Also, utilization of the resilient force of the rubber molding 2 ensures positive conduction between the conductive rubber portions 9, 10 and the metal terminals 3, 4. In addition, since the final product is completed by fixing the rubber molding 2 and the metal terminals 3, 4 to the housing 1 and then incorporating the contact sheet 5, the coil spring 6 and the stem 7 successively, the present push button switch can be assembled by a single series of automatic assembling steps and the assembly cost can be reduced remarkably.

Another advantage of the above-explained embodiment is in that since the conductive rubber portions 9, 10 of the rubber molding 2 are used as the fixed contacts, an impact produced upon buckling of the coil spring 6 is mitigated by the rubber molding 2 and a fear that a spark may occur when metal members are brought into contact with each other can be avoided. Since the rubber molding 2 can be formed such that the distance between a pair of the conductive rubber portions 9, 10 is determined with high accuracy through the insulating rubber portion 8 and a pair of the conductive rubber portions 9, 10 are surely insulated from each other even when they are closely disposed, still another advantage of an improvement in the space factor is resulted.

Furthermore, with the above-explained embodiment, since the contact sheet 5 is disposed in covering relation to the rubber molding 2, dusts can be prevented from intruding into the contact space. Also, since the metal terminals 3, 4 are not press-fitted into the housing 1, there is no fear that shavings of rectangular sheet material may adhere to the contacts. Thus, the present push button switch has the structure that the contacts are less susceptible to a failure in conduction or a short-circuited trouble.

It should be noted that while the above-explained embodiment uses the coil spring as an elastic buckling member, another type elastic member such as a leaf spring may be slantly disposed in the housing to be buckled.

While the contact sheet is formed by printing a conductive pattern on a resin film in the above-explained embodiment, it may be of any other member, such as a metal sheet, which has both flexibility and conductivity.

What is claimed is:

1. A push button switch comprising:

a housing having an opening formed in an upper surface thereof and an inner bottom surface;

a stem disposed in said opening, said stem being supported to be movable with respect to said housing;

a fixed contact member located on the inner bottom surface;

a movable contact member located adjacent the fixed contact; and an elastic member having a first end connected to said stem and a second end connected to said housing, said elastic member including a buckling portion located between the first and second ends, said elastic member being arranged in said housing such that when said stem is moved toward said inner bottom surface, said buckling portion contacts said movable contact member, thereby biasing said movable contact member into said fixed contact.

2. A push button switch according to claim 1, wherein a buckling compeller projection is provided on said stem for inducing said elastic member to buckle when said stem is moved toward said inner bottom surface of said housing.

3. A push button switch according to claim 1, wherein said fixed contact member comprises a pair of spaced apart conductive rubber portions separated by an insulating rubber portion.

4. A push button switch according to claim 3, further comprising connection terminals which have parts held in pressure contact with respective upper surfaces of said conductive rubber portions and which are locked to said housing by twisting those portions extending to the outside of said housing, whereby said fixed contact member is secured to the inner bottom surface of said housing by being sandwiched between said connection terminal and the inner bottom surface of said housing.

5. A push button switch comprising:

a housing having an opening formed in an upper surface thereof and an inner bottom surface;

a stem disposed in said opening, said stem being supported to be movable with respect to said housing;

first and second fixed contact members located on the inner bottom surface, the first fixed contact member being electrically isolated from the second fixed contact member; and a conductive elastic member having a first end connected to said stem and a second end connected to said housing, said elastic member including a buckling portion located between the first and second ends;

wherein said elastic member is arranged in said housing such that when said stem is moved toward said inner bottom surface, said buckling portion of said elastic member is brought into contact with said first and second fixed contact members, thereby providing an electrically conductive path between the first and second fixed contact members.

6. A push button switch comprising:

a housing having an opening formed in an upper surface thereof and an inner bottom surface;

a stem disposed in said opening, said stem being supported to be movable with respect to said housing;

first and second fixed contact members located on the inner bottom surface, the first fixed contact member being electrically isolated from the second fixed contact member; and an elastic member having a first end connected to said stem and a second end connected to said housing, said elastic member including a buckling portion located between the first and second ends; and a movable contact member disposed between said first and second fixed contact members and said elastic member, wherein said elastic member is arranged in said housing such that when said stem is moved toward said inner bottom surface, said buckling portion of said elastic member presses said movable contact member into contact with said first and second fixed contact members, thereby providing an electrically conductive path between the first and second fixed contact members.

* * * * *